US006560979B2

(12) United States Patent
Yamazaki et al.

(10) Patent No.: US 6,560,979 B2
(45) Date of Patent: May 13, 2003

(54) CONTROLLING METHOD OF ABSORPTION REFRIGERATOR

(75) Inventors: Shiguma Yamazaki, Tochigi-ken (JP); Eiichi Enomoto, Tochigi-ken (JP); Yasushi Kamata, Tochigi-ken (JP); Masahiro Furukawa, Tochigi-ken (JP)

(73) Assignees: Sanyo Electric Co., Ltd., Osaka-Fu (JP); Sanyo Electric Air Conditioning Co., Ltd., Tochigi-Ken (JP)

( * ) Notice: Subject to any disclaimer, the term of this patent is extended or adjusted under 35 U.S.C. 154(b) by 0 days.

(21) Appl. No.: 10/108,247

(22) Filed: Mar. 27, 2002

(65) Prior Publication Data

US 2002/0162341 A1 Nov. 7, 2002

(30) Foreign Application Priority Data

Mar. 28, 2001 (JP) ..... 2001-093352

(51) Int. Cl.[7] ..... F25B 15/00

(52) U.S. Cl. ..... 62/141; 62/476; 62/484; 62/267

(58) Field of Search ..... 62/476, 484, 267, 62/141

(56) References Cited

U.S. PATENT DOCUMENTS 4,085,596 A * 4/1978 Miyamoto et al. ..... 62/476
4,398,399 A * 8/1983 Itoh et al. ..... 62/475
4,912,934 A * 4/1990 Itoh et al. ..... 62/112
5,048,308 A * 9/1991 Hisajima et al. ..... 62/476
5,832,742 A * 11/1998 Kouri et al. ..... 62/479
6,247,331 B1 * 6/2001 Nishiguchi et al. ..... 62/476
6,487,874 B2 * 12/2002 Yamazaki et al. ..... 62/476

FOREIGN PATENT DOCUMENTS

JP 3-20671 3/1991

* cited by examiner

*Primary Examiner*—William C. Doerrler
*Assistant Examiner*—Mark Shulman
(74) *Attorney, Agent, or Firm*—Weingarten, Schurgin, Gagnebin & Lebovici LLP

(57) ABSTRACT

Prevention of the incapability of operation due to crystallization in the absorption solution. When the temperature difference (ΔT) between the temperature of the concentrated absorption solution Tr detected by the temperature sensor (22) and the temperature of crystallization Tc for the concentrated absorption solution at a specified concentration detected by the concentration sensor (21) comes within a prescribed figure, the opening of the heat control valve (20) is decreased by a specified figure, 20% for example. When the concentration of the concentrated absorption solution, which is measured by the concentration sensor (21), exceeds a prescribed figure, 65% for example, the heat supplied to the high temperature regenerator (1) is reduced by decreasing the opening of the heat control valve (20) regardless of the above temperature difference (ΔT). When the concentration of the concentrated absorption solution comes below a prescribed figure, 59% for example, the opening control for the heat control valve (20) is not conducted regardless of the above temperature difference (ΔT) allowing unlimited supply of heat to the high temperature regenerator (1).

10 Claims, 1 Drawing Sheet

CONTROLLING METHOD OF ABSORPTION REFRIGERATOR

BACKGROUND OF THE INVENTION

1. Field of the Invention

The present invention relates to a controlling method for an absorption refrigerator.

2. Detailed Description of the Prior Art

Generally it is necessary for improving the efficiency of an absorption refrigerator to increase the amount of heat exchanged between the low temperature heat exchanger and the high temperature heat exchanger. When the quantity of exchanged heat is increased by the expansion of surface area in the heat exchangers or by the improved thermal performance, a large temperature drop is observed for the concentrated absorption solution, which flows out of the low temperature heat exchanger. This is also accompanied with a sudden temperature drop for cooling water supplied to the absorber and the condenser. In this case a sudden temperature drop is also observed for a diluted absorption solution causing a sudden temperature drop for the concentrated absorption solution, which conducts heat exchange with the diluted absorption solution in the low temperature heat exchanger. The probability of crystallization for the concentrated absorption solution before entering the absorber is eventually increased.

For this reason, Japanese Published Unexamined Patent Application No. Hei03-20671 discloses an example of controlling the amount of heat supplied to a high temperature regenerator in a conventional absorption refrigerator when the concentration of a concentrated absorption solution flowing out of a low temperature heat exchanger exceeds a prescribed figure.

However, such controlling method focusing only on the concentration of a concentrated absorption solution flowing out of a low temperature heat exchanger does not establish a limitation for the heat supplied to a high temperature regenerator naturally when the above concentration comes below a prescribed figure. If the temperature of the concentrated absorption solution is accidentally lowered by some reasons, the concentrated absorption solution is readily crystallized, frequently resulting in the incapability of operation.

Meanwhile the above patent discloses another example, in which the control of concentration is carried out by changing the outlet temperature of the low temperature heat exchanger. This may allow unlimited supply of heat to the high temperature regenerator in spite of the excessively raised concentration of the concentrated absorption solution when the temperature of the concentrated absorption solution flowing out of the low temperature heat changer is accidentally raised by some factors such as degradation of thermal performance in the heat exchanger. Such method yields various mal-effects including drastic corrosion of metal parts in a pipeline for the absorption solution (corrosion rate quickens mainly at a section of high temperature).

Therefore, it is necessary to provide an absorption refrigerator, which should be never operated with the absorption solution exceeding a prescribed concentration, eliminating a possibility of drastic corrosion in metal parts. It should be firmly protected from crystallization in the absorption solution regardless of the operating conditions. These are the problems to be solved.

SUMMARY OF THE INVENTION

The present invention solves the above problems of the existing technologies by providing:

The first controlling method for an absorption refrigerator having a high temperature regenerator, a low temperature regenerator, a condenser, an absorber, a low temperature heat exchanger, and a high temperature heat exchanger, which are interconnected through a pipeline, wherein the concentration of a concentrated absorption solution flowing out of a low temperature regenerator into an absorber through a low temperature heat exchanger and the temperature of the concentrated absorption solution flowing out of the low temperature heat exchanger into the absorber are determined respectively, and a limitation is set up for the amount of heat supplied to the high temperature regenerator when the difference between the crystallizing temperature of the concentrated absorption solution calculated from the above concentration and the temperature of the above concentrated absorption solution comes within a prescribed figure.

The second controlling method according to the above first controlling method, wherein the concentration of the concentrated absorption solution is calculated based on the temperature of the concentrated absorption solution at the outlet of the low temperature regenerator and the condensing temperature of an employed coolant in the condenser.

The third controlling method according to the above first or the second controlling method, wherein a limitation is set up for the amount of heat supplied to the high temperature regenerator regardless of the above temperature difference when the concentration of the above concentrated absorption solution exceeds a prescribed figure.

The fourth controlling method according to the first or the second controlling method, wherein any limitation is not set up for the heat supplied to the high temperature regenerator regardless of the above temperature difference when the concentration of the above concentrated absorption solution comes below a prescribed figure.

The fifth controlling method according to the controlling methods from the first to the fourth, wherein the rotating rate of a pump for the absorption solution, which is installed on a certain place of a pipeline connecting the absorber and the high temperature regenerator through the low temperature heat exchanger, is elevated in place of, or in addition to the above-mentioned limitation on the heat supplied to the high temperature regenerator.

BRIEF DESCRIPTION OF THE INVENTION

DETAILED DESCRIPTION OF THE PREFERRED EMBODIMENTS

Detailed description of the present invention is given hereinafter in detail based on the attached drawing.

Figure 1:
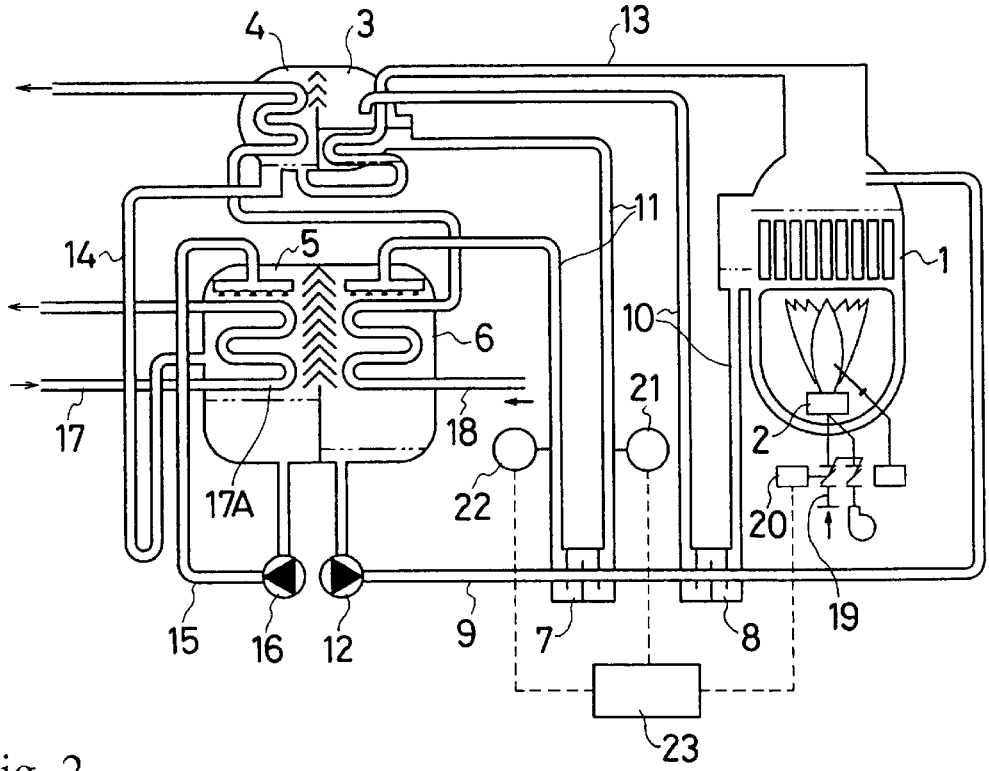
FIG. 1 is a schematic diagram illustrating a preferred embodiment for an absorption refrigerator controlled by a specific controlling method described in the present invention.

FIG. 1 illustrates a schematic diagram for an absorption refrigerator using water as the coolant and aqueous solution of lithium bromide (LiBr) as the absorption solution. The code (1) denotes a high temperature regenerator, in which the absorption solution is heated to accelerate evaporation and separation of the coolant based on the heat of a gas burner (2) fuelled, for example, by city gas. The code (3) denotes a low temperature regenerator, (4) a condenser, (5) an evaporator, (6) an absorber, (7) a low temperature heat exchanger, (9) through (11) pipes for absorption solution, (12) a pump for absorption solution, (13) through (15) pipes for coolant, (16) a pump for coolant, (17) a pipe for cooled water, (18) a pipe for cooling water, (19) a gas pipe connected to a gas burner (2), (20) a heat control valve, (21) a concentration sensor installed on the pipe for absorption solution (11) facing toward the inlet of the low temperature heat exchanger (7), (22) a temperature sensor installed on the pipe for absorption solution (11) facing toward the outlet of the low temperature heat exchanger (7), and (23) a controlling device for the opening of the heat control valve (20) based on the data detected by the concentration sensor (21) and the temperature sensor (22).

In an absorption refrigerator of the above constitution, a diluted absorption solution is heated to boiling in the high temperature regenerator (1) with the gas burner (2) fueled by city gas. Then the coolant vapor is separated from the diluted absorption solution by evaporation leaving an absorption solution of mid-concentration.

The coolant vapor of high temperature generated in the high temperature regenerator (1) is led into the low temperature regenerator (3) through the coolant pipe (13), heating the absorption solution of mid-concentration. The absorption solution of mid-concentration has been generated in the high temperature regenerator (1) and led into the low temperature regenerator (3) through the high temperature heat exchanger (8) via the absorption solution pipe. The coolant is condensed loosing heat, and led into the condenser (4).

The coolant separated from the absorption solution of mid-concentration by heating and evaporation in the low temperature regenerator (3) is led into the condenser (4), liquefied exchanging heat with the water flowing in the cooling water pipe (18). Then it is mixed with the condensed coolant supplied from the coolant pipe (13), and led into the evaporator (5) through the coolant pipe (14).

The liquefied coolant collected in the coolant vessel through the condenser (5) is sprayed by means of the coolant pump (16) on the heat conducting pipe (17A) that is connected to the cooled water pipe (17). It exchanges heat with the water supplied from the cooled water pipe (17), and evaporates effecting to cool the water flowing inside of the heat conducting pipe (17A).

The evaporated coolant in the evaporator (5) is introduced into the absorber (6) and absorbed into the concentrated absorption solution. The latter has been heated in the low temperature regenerator (3) separating the coolant by evaporation yielding the absorption solution of increased concentration. It is supplied from the absorption solution pipe (11) through the low temperature heat exchanger (7), and sprayed downward within the absorber.

The diluted absorption solution, which is defined as the absorption solution decreased of its concentration by absorption of the coolant in the absorber (6), is heated at the low temperature heat exchanger (7) and the high temperature heat exchanger (8) respectively being driven by the absorption solution pump (12). It is then sent to the high temperature regenerator (1) through the absorption solution pipe (9).

When an absorption refrigerator is operated in the above-mentioned way, the cooled water, which is cooled by the coolant with its vaporizing heat in the heat conducting pipe (17A) plumbed within the evaporator (5), may be circulated via the cooled water pipe (17) to air-conditioning loads that are not displayed in the figure. Thus the cooled water may be employed also for air-conditioning uses.

The controlling device (23) is equipped with a well-known function of controlling the opening of the heat control valve (20) for the stable operation of air-conditioning, etc. The temperature of cooled water, which is cooled in the heat conducting pipe (17A) and supplied from the cooled water pipe (17), is maintained at a prescribed temperature, 7° C. for example, by the device.

Figure 2:
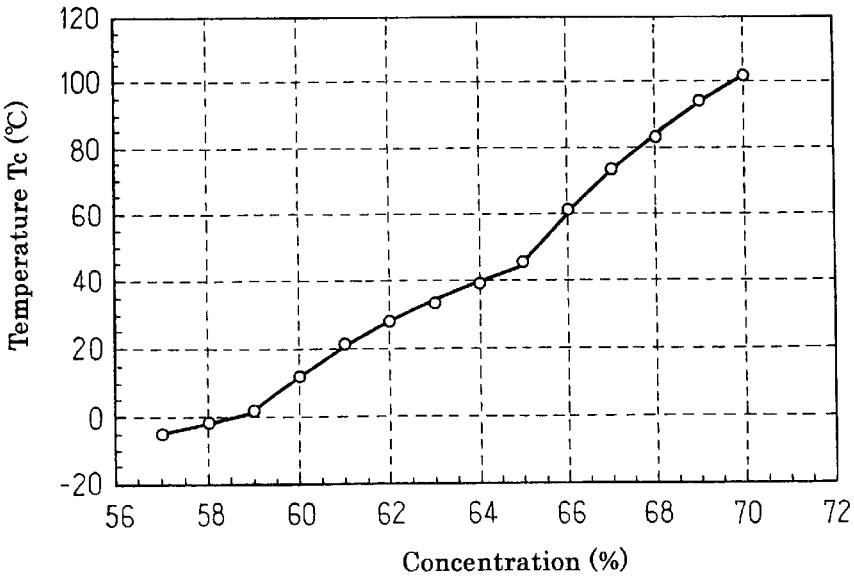
FIG. 2 is a drawing illustrating the dependence of the crystallization temperature on the concentration of the absorption solution.

The memory section of the controlling device (23), which is not displayed in the figure, memorizes the relation between the concentration of the absorption solution and the temperature of crystallization for the absorption solution at the concentration, which is illustrated in FIG. 2. Further, a controlling program is installed in the section and effects to decrease the opening of the heat control valve (20) to a prescribed figure, 20% for example, when the temperature difference $\Delta T$ (Tr−Tc) between the temperature of the concentrated absorption solution (Tr) detected by the temperature sensor (22) and the temperature of crystallization for the concentrated absorption solution at the concentration (Tc), which is calculated from the concentration of the concentrated absorption solution detected by the concentration sensor (21), comes within a prescribed figure, 3° C. for example.

Therefore, the signal transmitted from the controlling device (23) works to decrease the opening of the heat control valve (20) by a prescribed figure (20% in this case) for reducing power of the burner (2) when the concentration of the concentrated absorption solution, which is flowing from the low temperature regenerator (3) to the absorber (6) through the absorption solution pipe (11), is increased and the above Tr approaches the above Tc within a prescribed figure (3° C. in this case).

For the reason, the heating and concentrating action of the absorption solution is restricted for the high temperature regenerator (1) and the low temperature regenerator (3) respectively. To be more precise, the power of the gas burner (2) is suppressed in the high temperature regenerator (1) decreasing the amount of coolant vapor that is separated from the diluted absorption solution by evaporation, and also decreasing the condensing action for the diluted absorption solution. On the other hand, the amount of coolant vapor at a high temperature in the low temperature regenerator (3), which is generated in the high temperature regenerator (1) and flows into the low temperature regenerator via the coolant pipe (13), is decreased. This weakens the evaporating and separating action of the coolant obtained by heating the absorption solution of mid-concentration. The condensing action for the absorption solution of mid-concentration is thus decreased.

As a result, the concentration of the concentrated absorption solution, which flows from the low temperature regenerator (3) to the absorption solution pipe (11), is quickly decreased. Even when the temperature of the cooling water, which is supplied from the cooling water pipe (18) to the absorber (6) for the purpose of cooling the absorption solution, is accidentally lowered by some factors causing a sudden temperature drop in the concentrated absorption solution owing to the heat exchange with the diluted absorption solution of quickly lowered temperature, the concentrated absorption solution in the present invention is prevented from crystallization.

When the concentration of the concentrated absorption solution, which is measured by the concentration sensor (21), exceeds a prescribed figure, 65% for example, the controlling device (23) is designed to reduce the heating action over the diluted absorption solution by the gas burner (2) installed in the high temperature regenerator (1) even though the temperature difference (ΔT) between Tr and Tc is larger than the above prescribed figure (3° C. in this case). The controlling device (23) manages to do this by decreasing the opening of the heat control valve (20) by a prescribed figure (25% in this case). For this reason, the process can avoid the misconduct such as conspicuous generation of corrosion in the absorption solution pipe (11), which is generally made of steel, by an intrusion of the concentrated absorption solution having a concentration higher than the specification.

When the concentration of the concentrated absorption solution, which is measured by the concentration sensor (21), falls short of the specified lower limit of the concentration, 59% for example, at which the Tc (crystallizing temperature) is 0° C., the controlling device (23) is designed to stop the decreasing action for the opening of the heat control valve (20) even though the above temperature difference (ΔT) is less than a prescribed figure (3° C. in this case).

Therefore, when the concentration of the concentrated absorption solution is sufficiently low enough to exclude a fear of crystallization in spite of the fact that the temperature difference (ΔT) between Tr and Tc comes within the above prescribed figure (3° C. in this case), the decreasing control for the opening of the heat control valve (20) by a specified figure (20% in this case) is not put into practice. Thus the condensing action for the diluted absorption solution, which involves heating of the diluted absorption solution by the gas burner (2) in the high temperature regenerator (1) for the evaporation and separation of the coolant, is not weakened.

Meanwhile, the concentration of the concentrated absorption solution, which is supplied from the low temperature regenerator (3) to the absorber (6) through the absorption solution pipe (11), may be determined either by the direct detection using the concentration sensor (21), which is installed on an appropriated position on the absorption solution pipe (11) as is described in the above, or by the indirect calculation. In the indirect calculation, an experimental equation is first obtained for the function of T1, which is defined as the temperature of the concentrated absorption solution at a position just behind the outlet of the absorption solution pipe (11) facing toward the low temperature regenerator (3), and T2, which is defined as the temperature of condensation for the coolant in the condenser (4). For example, the concentration of the concentrated absorption solution C (%) may be calculated by a following equation;

$$C=139\times(T1+280)/(T2+273)-102.4$$

Such experimental equation may be stored in the memory section of the controlling device (23). The above T1 and T2 may be detected on necessity, and calculated by the experimental equation.

The indirect method for the determination of the concentration for the concentrated absorption solution based on the temperature detection also helps to reduce the manufacturing cost of the device as the detection is conducted by an inexpensive temperature sensor.

The present invention is not limited in any manner to the above embodiments, and various modifications are allowable. It may be modified at will unless it deviates from the scope of the invention expressed in the claims.

As an example of modification, a necessary program may be installed in the memory section of the controlling device (23) for increasing the rotating rate of the absorption solution pump (12) by a specified figure, 20% for example, when the above temperature difference (ΔT) between Tr and Tc comes within the above prescribed figure (3° C. in this case).

The constitution of the controlling device (23) as described in the above allows the following operation. Namely, the opening of the heat control valve (20) is decreased when the concentration of the concentrated absorption solution detected by the concentration sensor (21) is increased and the above temperature difference (ΔT) between Tr and Tc comes within a prescribed figure. As a result, the weakened gas burner (2) works to decrease the condensing action of the diluted absorption solution in the high temperature regenerator (1), which involves evaporation and separation of the coolant by the heating. At the same time, the rotating rate of the absorption solution pump (12) is increased by 20%, and the amount of the diluted absorption solution led from the absorber (6) into the high temperature regenerator (1) is increased by 20%. The concentration of the concentrated absorption solution supplied from the low temperature regenerator (3) to the absorber (6) through the low temperature heat exchanger (7) is diminished much more rapidly. Even when the temperature drop of the concentrated absorption solution is caused by the heat exchange with the low temperature heat exchanger (7), crystallization of the concentrated absorption solution becomes much harder to occur.

It is also possible to write a program for the controlling device (23), which is stored in the memory section of the device and executes either one of the two limiting controls: the limiting control of heat to the high temperature regenerator (1) by decreasing the opening of the heat control valve (including stopping operation of the gas burner for complete shutout) conducted when the above temperature difference (ΔT) comes within a prescribed figure, or the increasing control of the rotation rate for the absorption solution pump (12).

Concerning an absorption refrigerator employed in the invention, it may be an exclusive cooling type for air-conditioning as is illustrated in the above description, or a common cooling/heating type. As an example of the latter, a specific pipeline is installed for the coolant vapor, which has been generated by heating in the high temperature regenerator (1), and the absorption solution, which has been removed of the coolant vapor, so that they are directly fed to the bottoms of the absorber (6) and the evaporator (5) respectively. Thus the diluted absorption solution may be heated without sending cooling water into the cooling water pipe (18), while the water, which has been warmed up to about 55° C. in the heat conducting pipe (17A) within the absorber (6), is led into the cooling water pipe (17) (should be preferably called the warming water pipe in this case) and then to warming loads in a circulative manner for the room warming, etc.

With regard to the coolant fluid supplied to air-conditioning loads after cooled in the evaporator (6), water may be usable as shown in the above embodiments without the phase change. Other substances like fleons may be also used applying their phase change so that the heat transfer is conducted more efficiently using the latent heat.

As have been described in detail, the present invention provides a dependable method of preventing crystallization for the absorption solution. The corrosion of metal parts in the absorption solution pipe, etc. may be suppressed since the circulation of the absorption solution exceeding the specified concentration is totally prevented.

What is claimed is:

1. A controlling method for an absorption refrigerator having a high temperature regenerator, a low temperature regenerator, a condenser, an absorber, a low temperature heat exchanger, and a high temperature heat exchanger, which are interconnected through a pipeline, wherein the concentration of a concentrated absorption solution flowing out of the low temperature regenerator into the absorber through the low temperature heat exchanger and the temperature of the concentrated absorption solution flowing out of the low temperature heat exchanger into the absorber are determined respectively, and a limitation is set up for the amount of heat supplied to the high temperature regenerator when the difference between the crystallizing temperature of the concentrated absorption solution calculated from the above concentration and the temperature of the above concentrated absorption solution comes within a prescribed figure.

2. A controlling method for an absorption refrigerator according to claim 1 wherein the concentration of the concentrated absorption solution is calculated based on the temperature of the concentrated absorption solution at the outlet of the low temperature regenerator and the condensing temperature of an employed coolant in the condenser.

3. A controlling method for an absorption refrigerator according to claim 1 wherein a limitation is set up for the amount of heat supplied to the high temperature regenerator regardless of the above temperature difference when the concentration of the above concentrated absorption solution exceeds a prescribed figure.

4. A controlling method for an absorption refrigerator according to claim 1 wherein any limitation is not set up for the heat supplied to the high temperature regenerator regardless of the above temperature difference when the concentration of the above concentrated absorption solution comes below a prescribed figure.

5. A controlling method for an absorption refrigerator according to claim 1 wherein the rotating rate of a pump for the absorption solution, which is installed on a certain place of a pipeline connecting the absorber and the high temperature regenerator through the low temperature heat exchanger, is elevated in place of, or in addition to the above-mentioned limitation on the heat supplied to the high temperature regenerator.

6. A controlling method for an absorption refrigerator according to claim 2 wherein a limitation is set up for the amount of heat supplied to the high temperature regenerator regardless of the above temperature difference when the concentration of the above concentrated absorption solution exceeds a prescribed figure.

7. A controlling method for an absorption refrigerator according to claim 2 wherein any limitation is not set up for the heat supplied to the high temperature regenerator regardless of the above temperature difference when the concentration of the above concentrated absorption solution comes below a prescribed figure.

8. A controlling method for an absorption refrigerator according to claim 2 wherein the rotating rate of a pump for the absorption solution, which is installed on a certain place of a pipeline connecting the absorber and the high temperature regenerator through the low temperature heat exchanger, is elevated in place of, or in addition to the above-mentioned limitation on the heat supplied to the high temperature regenerator.

9. A controlling method for an absorption refrigerator according to claim 3 wherein the rotating rate of a pump for the absorption solution, which is installed on a certain place of a pipeline connecting the absorber and the high temperature regenerator through the low temperature heat exchanger, is elevated in place of, or in addition to the above-mentioned limitation on the heat supplied to the high temperature regenerator.

10. A controlling method for an absorption refrigerator according to claim 4 wherein the rotating rate of a pump for the absorption solution, which is installed on a certain place of a pipeline connecting the absorber and the high temperature regenerator through the low temperature heat exchanger, is elevated in place of, or in addition to the above-mentioned limitation on the heat supplied to the high temperature regenerator.

* * * * *